US010946542B2

(12) United States Patent
Higbie et al.

(10) Patent No.: US 10,946,542 B2
(45) Date of Patent: Mar. 16, 2021

(54) SCISSOR ASSEMBLY

(71) Applicant: MaPLE Street Products, LLC, Greenwood Village, CO (US)

(72) Inventors: Regina Trainer Higbie, Greenwood Village, CO (US); Matthew James Higbie, Greenwood Village, CO (US); Robert Milton Miller, Golden, CO (US)

(73) Assignee: MaPLE Street Products, LLC, Greenwood Village, CO (US)

( * ) Notice: Subject to any disclaimer, the term of this patent is extended or adjusted under 35 U.S.C. 154(b) by 15 days.

(21) Appl. No.: 16/103,978

(22) Filed: Aug. 16, 2018

(65) Prior Publication Data

US 2019/0054643 A1 Feb. 21, 2019

Related U.S. Application Data

(60) Provisional application No. 62/546,388, filed on Aug. 16, 2017.

(51) Int. Cl.
*B26B 29/04* (2006.01)
*B26B 13/18* (2006.01)

(52) U.S. Cl.
CPC ..... *B26B 29/04* (2013.01); *B26B 13/18* (2013.01)

(58) Field of Classification Search
CPC ..... B26B 29/04; B26B 13/18; B26B 13/285; B26B 13/00; B25B 7/06; B25B 7/18; B25B 7/10; A61B 17/2812; B26D 3/169
USPC ..... 30/254, 259, 266, 258, 268, 269, 257, 30/231, 92, 341, 90.1, 250, 252, 124, 30/253, 28; 15/160; 83/13
See application file for complete search history.

(56) References Cited

U.S. PATENT DOCUMENTS 519,999 A * 5/1894 Godbey ..... B26B 13/20 30/232
1,134,849 A * 4/1915 Hawkins ..... B26B 13/20 30/232
2,272,753 A * 2/1942 Steinhardt ..... B26B 13/06 30/233
2,591,740 A * 4/1952 Stilwell ..... B26B 29/04 30/233
2,819,521 A * 1/1958 Parker ..... B26B 19/00 30/135
3,374,541 A * 3/1968 Earnest, III ..... A01D 46/247 30/232
4,235,016 A * 11/1980 Kobelt ..... B26B 29/04 30/233

(Continued)

*Primary Examiner* — Ghassem Alie
(74) *Attorney, Agent, or Firm* — Holland & Hart LLP

(57) ABSTRACT

The disclosed technology includes a scissor assembly and method for using the scissor assembly. In some implementations, the scissor assembly includes first handle and a second handle connecting to each other via a flexible connector loop, two blades located on a first interior surface of the first handle and a first interior surface of the second handle, wherein the two blades are configured to slide adjacent to one another when the two handles are pushed towards each other. The scissor assembly may also include a lock to connect the two handles, the lock including a guide post located on the first handle configured to slidably move in a guide slot located in the second handle, a mouth located between the two blades when the scissor assembly is in an open position, the mouth to receive a first object of a predetermined size.

8 Claims, 6 Drawing Sheets

(56) References Cited

U.S. PATENT DOCUMENTS

| | | | | | |
|---|---|---|---|---|---|
| 5,297,342 | A * | 3/1994 | Malone | B26B 29/04 | 30/233 |
| 5,964,033 | A * | 10/1999 | Wolf | A45D 29/16 | 30/175 |
| D613,571 | S * | 4/2010 | Quante | D8/51 | |
| D817,135 | S * | 5/2018 | Huesman | D8/57 | |
| 2013/0327348 | A1* | 12/2013 | Ashur | B26B 29/04 | 132/73.6 |
| 2014/0317939 | A1* | 10/2014 | Greer | B26B 13/06 | 30/233 |

* cited by examiner

SCISSOR ASSEMBLY

PRIORITY CLAIM

The present application claims benefit of priority to U.S. Patent Application Ser. No. 62/546,388 filed on Aug. 16, 2017 and titled "Scissor Assembly," which is hereby incorporated by reference for all that they disclose or teach.

BACKGROUND OF THE INVENTION

Many scissors have sharp blades that can cause injury to children or elderly users. Safer scissors have been manufactured with smoother blade surfaces, such as blades made of plastic. However, such scissors intended to avoid injury may not be useful as the plastic blades are not sharp enough to cut objects.

SUMMARY

The technology disclosed herein includes a scissor assembly and method for using the scissor assembly. In some implementations, the scissor assembly includes two handles, a first a scissor assembly and method for using the scissor assembly. In some implementations, the scissor assembly includes first handle and a second handle connecting to each other via a flexible connector loop, two blades located on a first interior surface of the first handle and a first interior surface of the second handle, wherein the two blades are configured to slide adjacent to one another when the two handles are pushed towards each other. The scissor assembly may also include a lock to connect the two handles, the lock including a guide post located on the first handle configured to slidably move in a guide slot located in the second handle, a mouth located between the two blades when the scissor assembly is in an open position, the mouth to receive a first object of a predetermined size.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Other features, details, utilities, and advantages of the claimed subject matter will be apparent from the following more particular written Detailed Descriptions of various implementations as further illustrated in the accompanying drawings and defined in the appended claims.

These and various other features and advantages will be apparent from a reading of the following Detailed Descriptions.

BRIEF DESCRIPTIONS OF THE DRAWINGS

DETAILED DESCRIPTIONS

The disclosed technology includes a scissor assembly designed to prevent a user's fingers from contacting the cutting edges of the blades of the scissor assembly. Specifically, an object may be inserted into a mouth of the scissor assembly, which includes an integrated guard. The integrated guard prevents the object (e.g., a user's fingers) of a predetermined size from entering the mouth. A user may press two handles of the scissor assembly together and cut the object with two blades that are located on the two handles.

In some implementations, the scissor assembly may be ambidextrous, and operated with a user's right or left hand. In some implementations, the user may squeeze the scissor assembly with one or two hands, and a first cutting surface (or a first blade) located on a first handle slidably moves toward a second cutting surface (or a second blade), cutting an object inserted in a mouth of the second handle. After cutting, the scissor assembly may automatically return to an open position. In some implementations, the scissor assembly may or may not require a spring mechanism to return to open position.

Figure 1A:
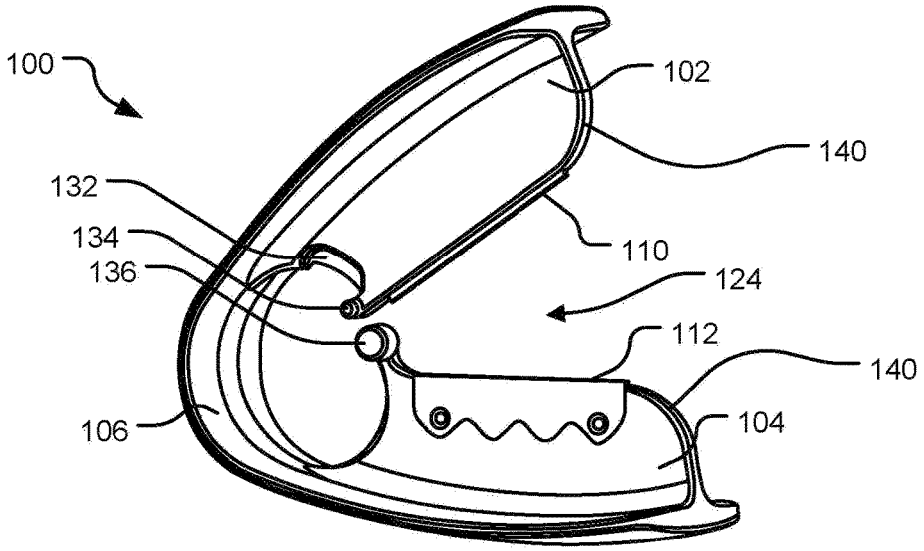
FIGS. 1A-1C illustrate side views of an example scissor assembly.
Figure 1B:
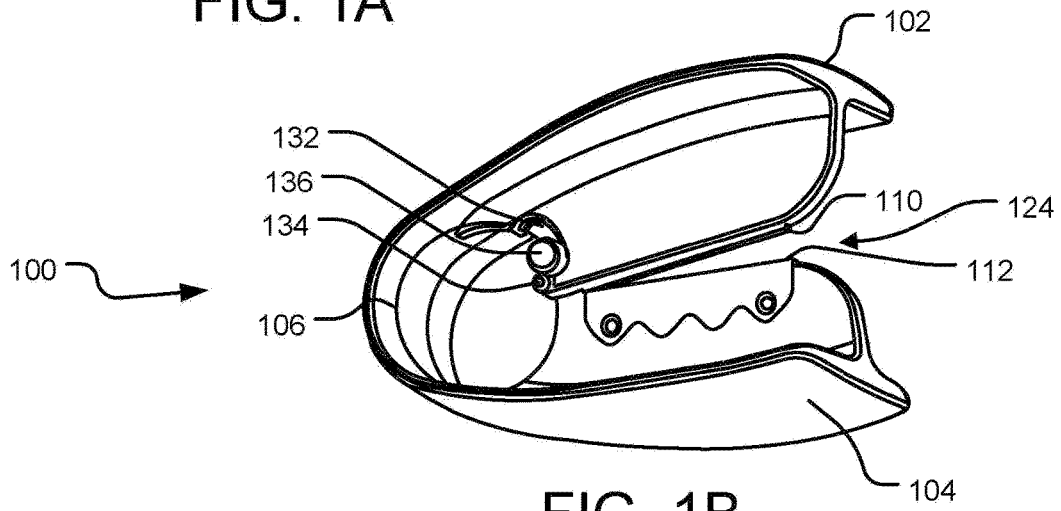
Figure 1C:
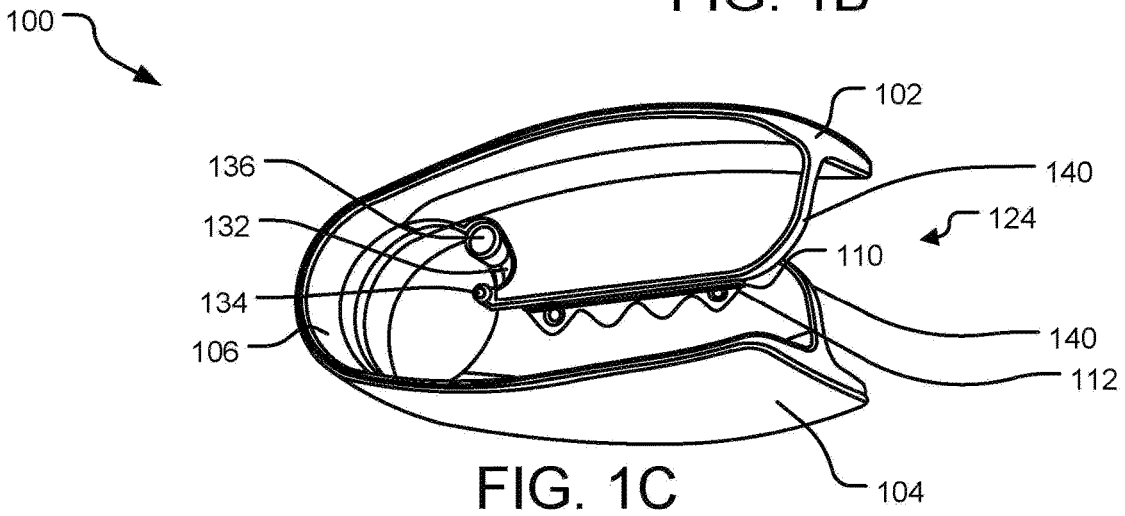

FIGS. 1A-1C illustrate side views of an example scissor assembly 100. FIG. 1A illustrates a side view of an unassembled scissor assembly 100. FIG. 1B illustrates a side view of an assembled scissor assembly 100 in an open position. FIG. 1C illustrates a side view of an assembled scissor assembly 100 in a closed position.

In FIGS. 1A-1C, the scissor assembly 100 is a single component, molded open and includes two handle portions (e.g., a first handle 102 and a second handle 104) molded two a flexible connector loop (e.g., a flexible connector loop 106). In the implementation shown in FIG. 5, the flexible connector loop 106 is a spring, and functions as an integrated spring mechanism to press the handles toward each other to facilitate cutting.

A mouth (e.g., mouth 124) is shown located between the first handle 102 and the second handle 104 and configured to receive an object (not shown). In some implementations, the mouth is located between the two handles. In some implementations, the mouth is located in one of the handles (see mouth located in the second handle in FIG. 2.). In some implementations, the opening of the mouth 124 is approximately ⅛ inch, which prevents insertion of a user's fingers into the mouth 124 and thereby, prevents contact with the cutting edges of the two blades located on surfaces of the first handle 102 and the second handle 104 (e.g., first blade 110 and second blade 112), wherein the two blades are configured to slide adjacent to one another and cut an object inserted into the mouth 124. The first blade 110 and second blade 112 cross each other on a shearing plane (not shown). The first blade 110 and second blade 112 may be attached to the first handle 102 and the second handle 104 by a variety of methods (e.g., molding in place, heat staking, etc.).

As an object is inserted into the mouth 124 by a user, two filleted (rounded) edges (e.g., filleted edge 140 located on the first handle 102 and filleted edge 140 located on the second handle 104) proximate to the cutting blades help a user feed an object to be cut into the narrow cutting mouth 124.

As shown in FIGS. 1A-1C, the two handles may be connected to each other via a locking mechanism, which includes a guide post 132, a guide slot 134, and a limiting post 136. The guide post 132 and the guide slot 134 mate with each other and also guide the motion of the first handle 102 and second handle 104 as an object inserted in the mouth 124 is deflected and prevents two halves of the object from being pried apart (e.g., sheer contact is maintained). The limiting post 136 locks or limits the guide post from moving out of the guide slot.

Figure 5A:
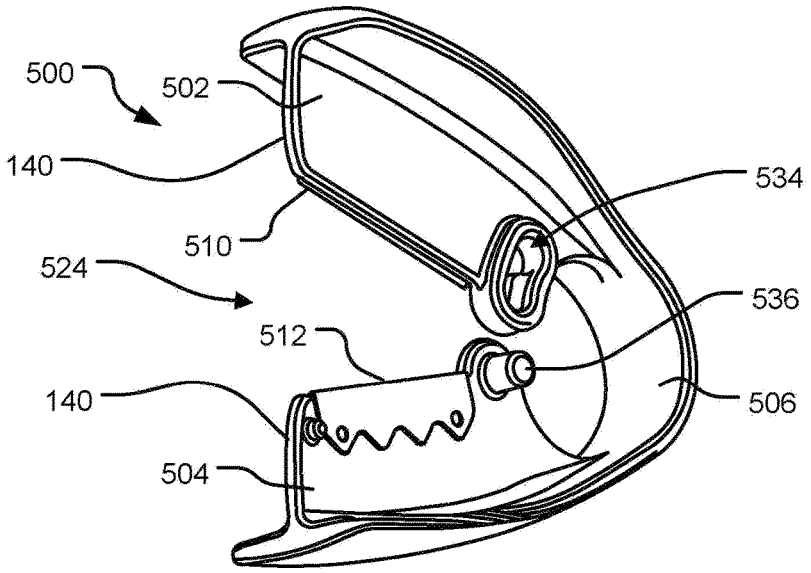
FIGS. 5A-5C illustrate side views of an example scissor assembly.
Figure 5B:
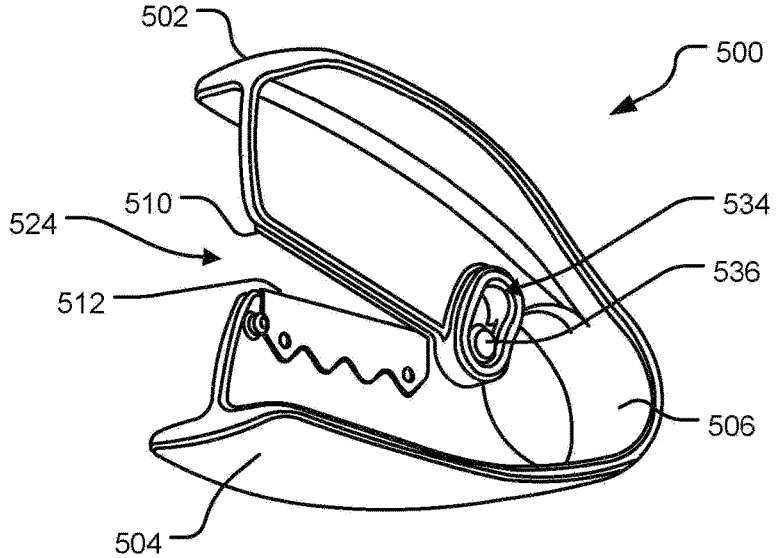
Figure 5C:
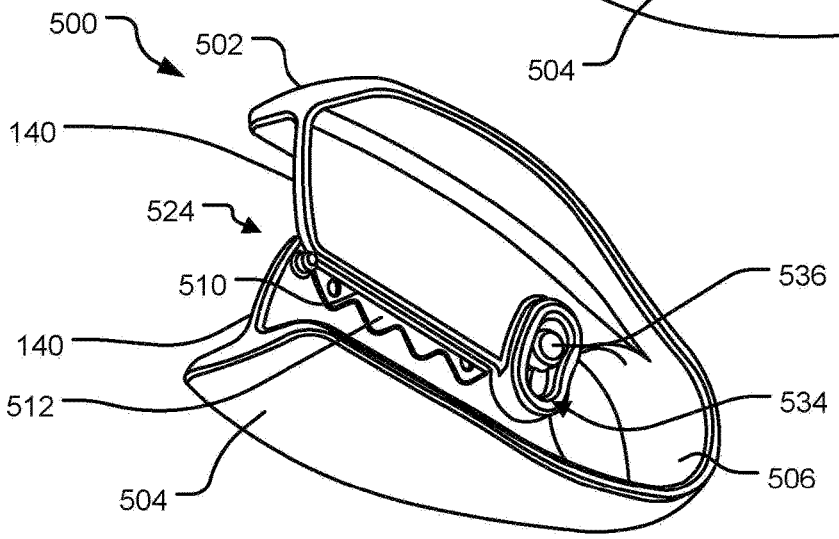

In some implementations, the guide slot 134 is an open slot, as shown in FIGS. 1A-C. In other implementations, the guide slot 134 is an aperture or encapsulated slot, as shown in FIGS. 5A-C.

In some implementations, the two handles may only be connected to one another via the flexible connector loop 106, shown here as a spring. In some implementations, the two handles may be connected to one another by another attaching method.

A user may grasp the scissor assembly 100 using a palmar grasp. In some implementations, the scissor assembly 100 may be operated with a variety of grasp patterns. In some implementations, the safety scissor assembly includes a universal design for use by children, adults, and a special needs population.

In some implementations, the scissor assembly 100 is comprised of a one-piece molded plastic body, however, assembly of multiple components and use of other materials are contemplated depending on the intended use. For example, the scissor assembly 100 may include components made of rubber, thermoplastic, paper cardboard, metal foil, cloth rope wire, etc. The scissor assembly 100 may be utilized for haircutting, paper cutting, food preparation, or other applications. The size of the scissor assembly 100 may vary. In some implementations, the scissor assembly 100 may be approximately 20 cm long and 15 cm tall.

As shown in FIG. 1B, the guide post 132 and the guide slot 134 mate with each other. As a user closes the scissor assembly 100 to cut an object, the guide post 132 and the guide slot 134 guide the motion of the first handle 102 and second handle 104 as an object inserted in the mouth 124 is deflected and prevents two halves of the object from being pried apart (e.g., sheer contact is maintained).

FIG. 1C shows the scissor assembly 100 in a closed position. The guide post 132 has moved away from the limiting post in the guide slot 134, as the first handle 102 and second handle 104 approach one another and the first blade 110 and second blade 112 cross each other on a shearing plane.

Figure 2:
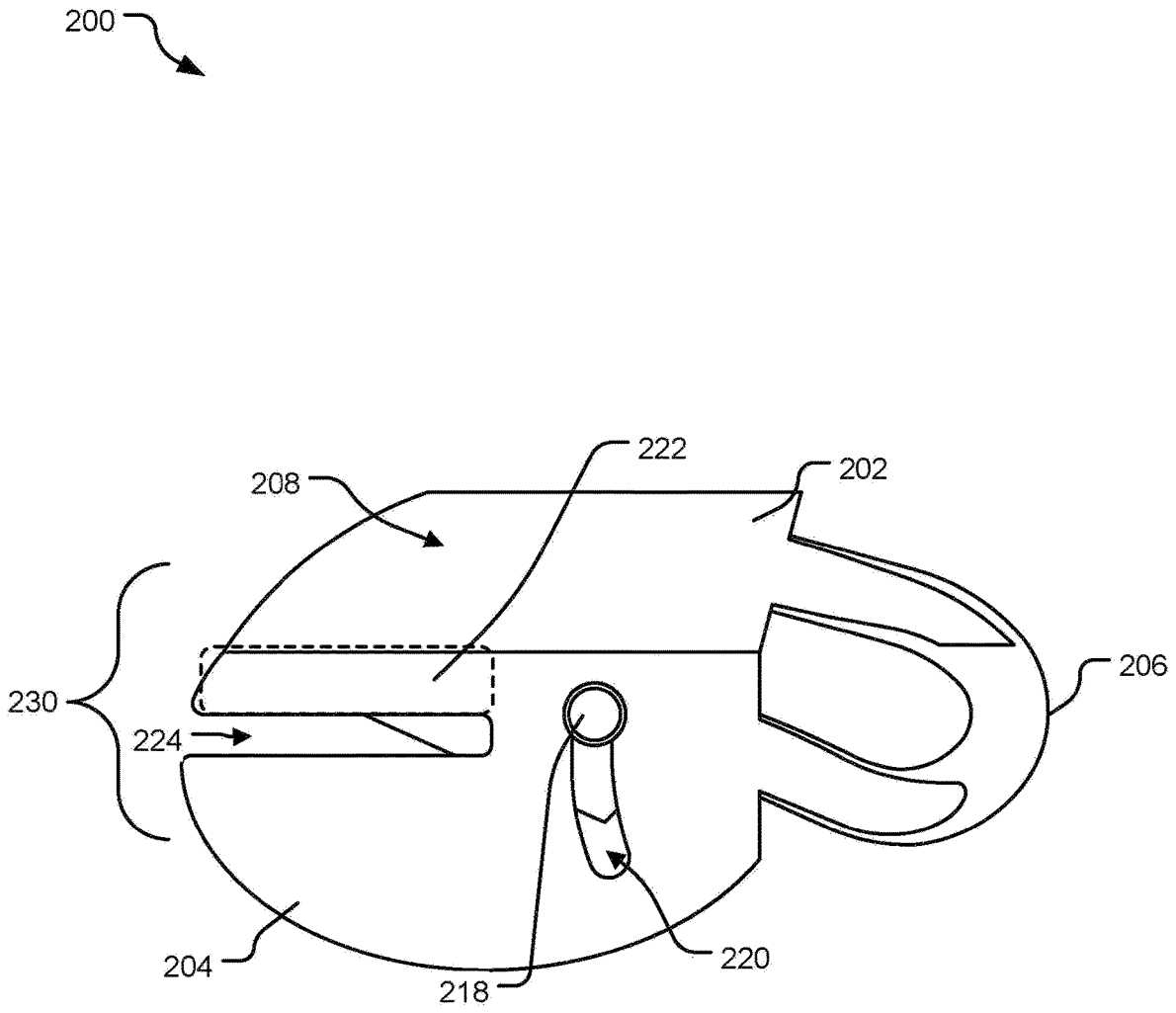
FIG. 2 illustrates a side view of an example scissor assembly.

FIG. 2 illustrates a side view of an example scissor assembly 200. The scissor assembly 200 includes two handles (e.g., a first handle 202 and a second handle 204) connecting to each other via a flexible connector loop (e.g., a flexible connector loop 206). A mouth (e.g., mouth 224) is located in the second handle 204 and configured to receive an object (not shown).

The scissor assembly 200 includes an integrated guard (e.g., integrated guard 222 highlighted by dotted lines) located in the mouth 224 of the second handle 204. The integrated guard 222 may be located opposite a blade (shown and described in FIGS. 3A and 3B) in the mouth 224. The integrated guard 222 controls the size of an object than can be cut. The integrated guard 222 is configured to prevent objects of a predetermined size from entering the mouth and is configured to enable the mouth to receive objects of a predetermined size. As a result, certain larger objects (e.g., a user's fingers) cannot enter the mouth. For example, the integrated guard 222 is big enough for foil bags, but too small for a user's fingers. In some implementations, the integrated guard 222 is plastic, but other materials are contemplated.

In some implementations, the mouth 224 may be approximately 7 cm deep (e.g., large enough to cut a tube of yogurt with one snip) and approximately 1 cm wide (too small to fit a user's finger). In such implementations, the mouth via the guard is configured receive objects of a predetermined size (e.g., objects measuring less than 1 cm wide) and configured to prevent objects of a predetermined size (e.g., objects measuring more than 1 cm wide).

The scissor assembly 200 includes two blades (shown and described in FIGS. 3A and 3B) located on surfaces of the first handle and the second handle, wherein the two blades are configured to slide adjacent to one another and cut an object inserted into the mouth 224. The two blades on the first handle 202 and the second handle 204 cross each other on a shearing plane 208.

As shown in FIG. 2, the two handles are further connected to each other via a peg (e.g., peg 218) located on the first handle 202 configured to slidably move in an arced slot 220 of the second handle 204. The peg 218 and the arced slot 220 guide the motion of the first handle 202 and second handle 204 as an object inserted in the mouth 224 is deflected and prevents two halves of the object from being pried apart (e.g., sheer contact is maintained).

In some implementations, the two handles may only be connected to one another via the flexible connector loop 206. In some implementations, the two handles may be connected to one another by another attaching mechanism.

In an open position, the design of the scissor assembly 200 prevents a user's fingers from locating in, near, or between the blades. In some implementations, such as in FIG. 2, the scissor assembly 200 has a curved front 230, which helps guide an object or material into position for cutting.

A user may grasp the scissor assembly 200 using a palmar grasp. In some implementations, the scissor assembly 200 may be operated with a variety of grasp patterns. In some implementations, the safety scissor assembly includes a universal design for use by children, adults, and a special needs population.

In some implementations, the scissor assembly 200 is comprised of a one-piece molded plastic body, however, assembly of multiple components and use of other materials are contemplated depending on the intended use. For example, the scissor assembly 200 may include components made of rubber, thermoplastic, paper cardboard, metal foil, cloth rope wire, etc. The scissor assembly 200 may be utilized for haircutting, paper cutting, food preparation, or other applications. The size of the scissor assembly 200 may vary. In some implementations, the scissor assembly 200 may be approximately 20 cm long and 15 cm tall.

In some implementations, the assembly includes a guard (shown and described in FIG. 4) located on a second interior surface of the mouth in the second handle. The mouth 224 is sized smaller than an intended user's finger (e.g., 1 cm).

Figure 3A:
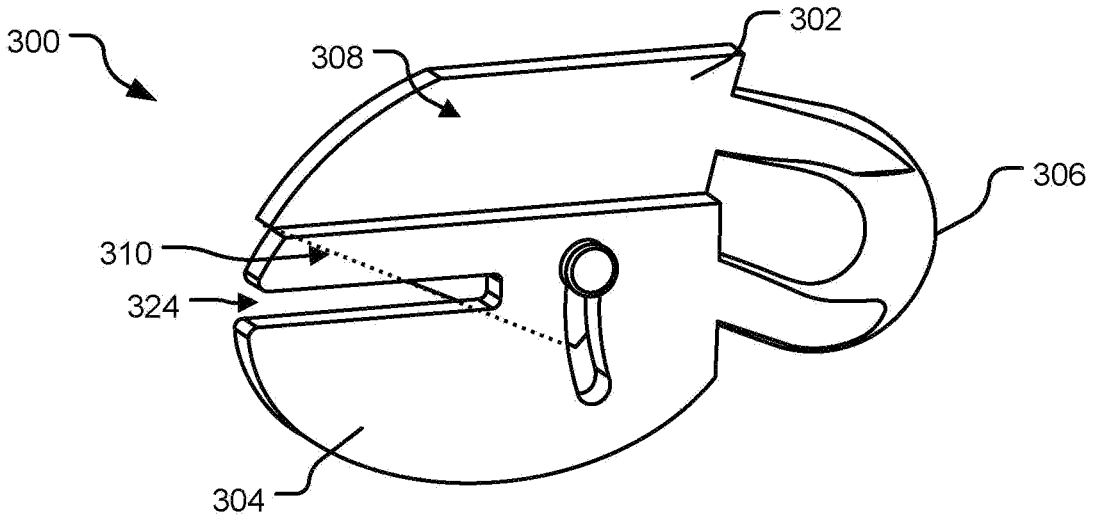
FIGS. 3A and 3B illustrate a side front perspective view and a side back perspective view.
Figure 3B:
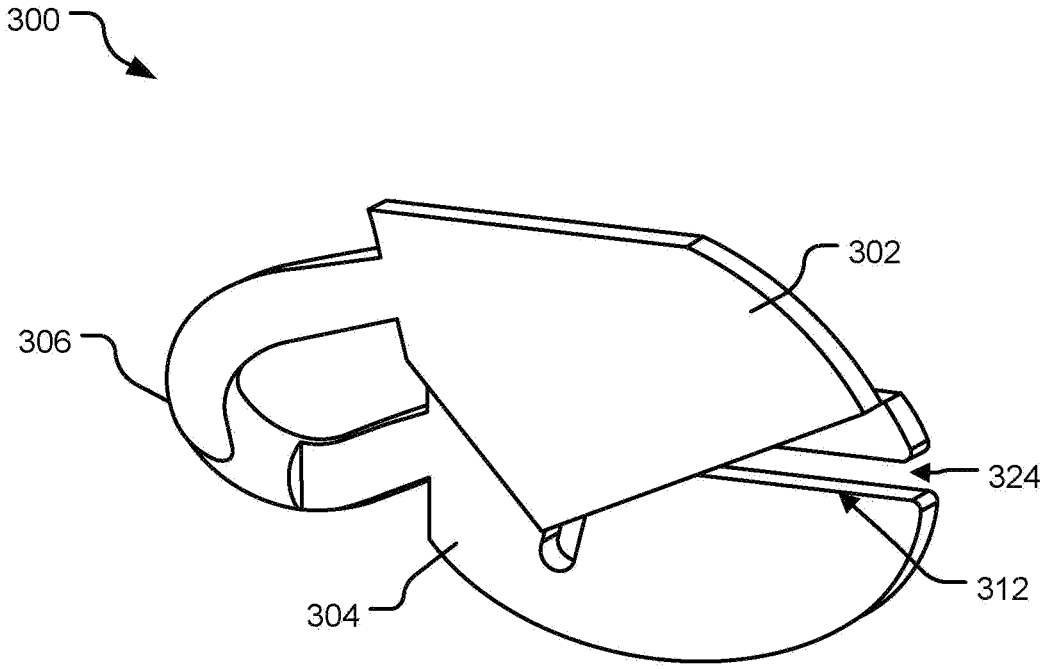

FIGS. 3A and 3B illustrate a side front perspective view and a side back perspective view of an example scissor assembly 300. The scissor assembly 300 includes two handles (e.g., a first handle 302 and a second handle 304) connecting to each other via a flexible connector loop (e.g., a flexible connector loop 306). A mouth (e.g., mouth 324) is located in the second handle 304 and configured to receive an object (not shown). The mouth includes a guard (shown and described in FIG. 4) that due to its location and size limits objects of predetermined size (e.g., a user's finger) from entering the mouth 324.

The scissor assembly 300 includes two blades or cutting surfaces (e.g., first blade 310 and second blade 312) located on surfaces of the first handle 302 and the second handle 304. The first blade 310 and second blade 312 are configured to slide adjacent to one another and cut an object inserted into the mouth 324. The first blade 310 and second blade 312 cross adjacent to each other on a shearing plane 308. The point at which the first blade 310 and second blade 312 cross is the point at which the material or object (e.g., foil wrapper) may be cut. As the first handle 302 and the second handle 304 are squeezed together, the cutting point moves along each blade, extending a cut in the material or object.

In some implementations, the first blade 310 and second blade 312 may be stainless steel blades pressed into plastic on the first handle 302 and the second handle 304. The first blade 310 and the second blade 312 may be retained with small holes in the blades intended to aid in fastening the first blade 310 and the second blade 312 to the blade 310 and second blade 312. The first blade 310 and the second blade 312 may be pressed in when the plastic is cooling, and the material from the first handle 302 and the second handle 304 squeezes into the holes. The first blade 310 and the second blade 312 are secured firmly as the plastic cools.

Figure 4:
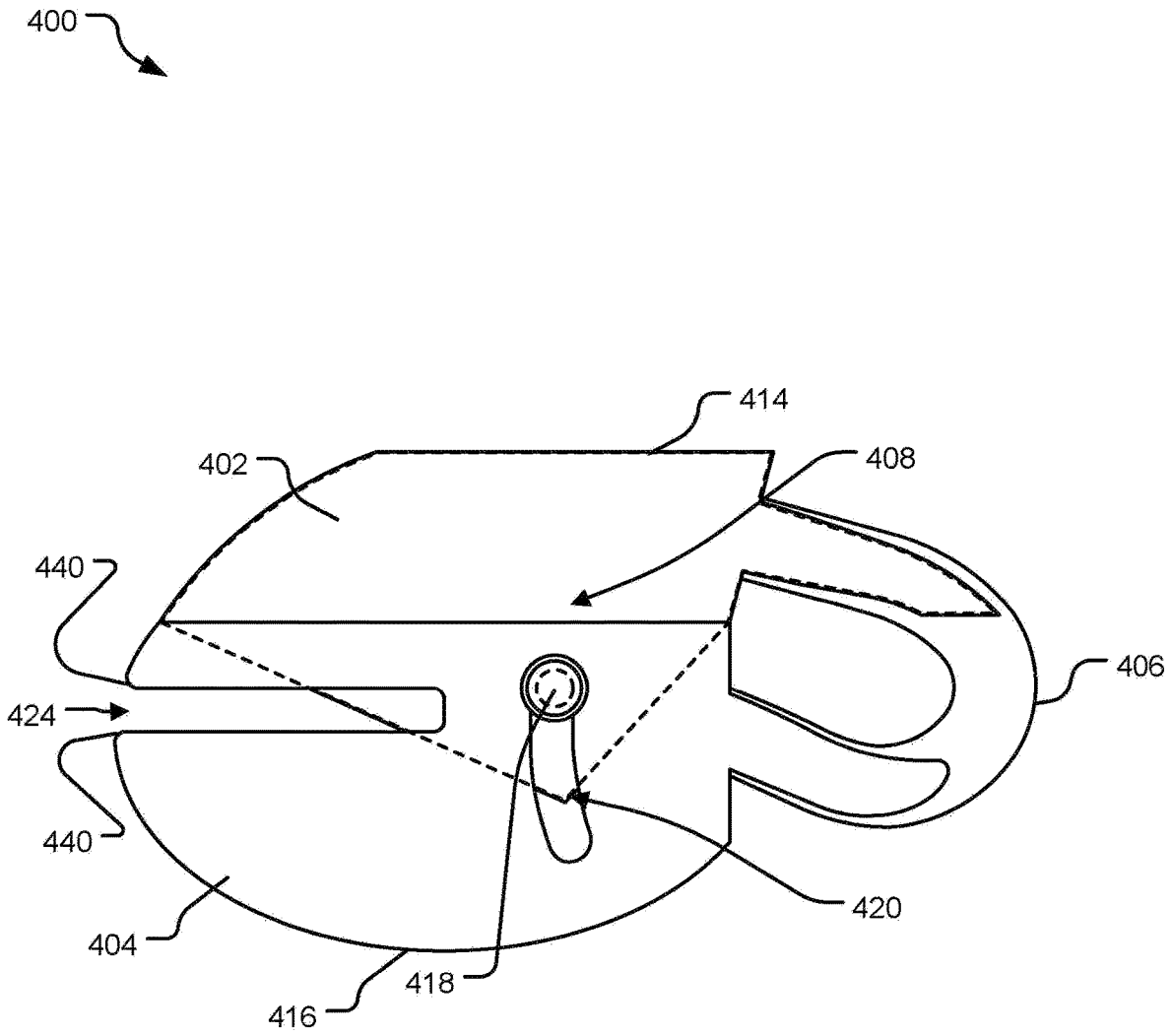
FIG. 4 illustrates the kinematics of an example scissor assembly.

FIG. 4 illustrates the kinematics of an example scissor assembly 400. The scissor assembly 400 includes two handles (e.g., a first handle 402 and a second handle 404) connecting to each other via a flexible connector loop (e.g., a flexible connector loop 406). A mouth (e.g., mouth 424) is located in the second handle 404 and configured to receive an object (not shown).

The scissor assembly 400 includes two blades or cutting surfaces (not shown) located on surfaces of the first handle 402 and the second handle 404. The blades are configured to slide adjacent to one another and cut an object inserted into the mouth 424. The point at which the blades cross is the point at which the material or object (e.g., foil wrapper) may be cut. The first handle 402 and the second handle 404 are squeezed together with the user applying pressure on an outside edge surface 414 of the first handle 402 and an outside edge surface 416 of the second handle 404. A cutting point moves along each blade, extending a cut in the material or object.

The flexible connector loop 406 joins the first handle 402 and the second handle 404 of the scissor assembly 400. The scissor assembly 400 is formed in an over-opened position. The zero-stress state of the scissor assembly 400 is at a larger angle than a peg 418 and an arced slot 420 and slot will allow. Thus, the scissor assembly 400 is preloaded with an opening force. After the squeezing force is removed, the scissor assembly 400 returns to a starting position.

In some implementations, the scissor assembly 400 is molded with the first handle 402 and the second handle 404 co-planar. When the first handle 402 and the second handle 404 are deformed such that the first handle 402 is aligned behind, or adjacent to, the second handle 404, the strain applied want to push them back to co-planar, which sets and maintains pressure force between the first handle 402 and the second handle 404.

As the scissor assembly 400 is squeezed and the first handle 402 and the second handle 404 are pressed together, the peg 418 and the arced slot 420 perform two functions. First, the peg 418 and the arced slot 420 guide the kinematics of the first handle 402 with respect to the second handle 404. Second, a screw (not shown) in the peg 418 aids in maintaining a consistent pressure in the shear plane 408.

FIGS. 5A-5C illustrate side views of an example scissor assembly 500. FIG. 5A illustrates a side view of an unassembled scissor assembly 500. FIG. 1B illustrates a side view of an assembled scissor assembly 500 in an open position. FIG. 5C illustrates a side view of an assembled scissor assembly 500 in a closed position.

In FIGS. 5A-5C, the scissor assembly 500 is a single component, molded open and includes two handle portions (e.g., a first handle 502 and a second handle 504) molded two a flexible connector loop (e.g., a flexible connector loop 506). In the implementation shown in FIG. 6, the flexible connector loop 506 is a spring, and functions as an integrated spring mechanism to press the handles toward each other to facilitate cutting.

A mouth (e.g., mouth 524) is located between the first handle 502 and the second handle 504 and configured to receive an object (not shown). In some implementations, the opening of the mouth 524 is approximately ⅛ inch, which prevents insertion of a user's fingers into the mouth 524 and thereby, prevents contact with the cutting edges of the two blades located on surfaces of the first handle 502 and the second handle 504 (e.g., first blade 510 and second blade 512), wherein the two blades are configured to slide adjacent to one another and cut an object inserted into the mouth 524. The first blade 510 and second blade 512 cross each other on a shearing plane (not shown). The first blade 510 and second blade 512 may be attached to the first handle 502 and the second handle 504 by a variety of methods (e.g., molding in place, heat staking, etc.).

As an object is inserted into the mouth 524 by a user, two filleted (rounded) edges (e.g., filleted edge 540 located on the first handle 502 and filleted edge 540 located on the second handle 504) proximate to the cutting blades help a user feed an object to be cut into the narrow cutting mouth 524.

As shown in FIGS. 5A-5C, the two handles may be connected to each other via a locking mechanism, which includes a guide post 532, a guide slot 534, and a limiting post 536. The guide post 532 and the guide slot 534 mate with each other and also guide the motion of the first handle 502 and second handle 504 as an object inserted in the mouth 524 is deflected and prevents two halves of the object from being pried apart (e.g., sheer contact is maintained).

In some implementations, the guide slot 134 is an aperture or encapsulated slot, as shown in FIGS. 5A-C. In other implementations, the guide slot 134 is an open slot, as shown in FIGS. 1A-C. In some implementations, there may or may not be a limiting post.

In some implementations, the two handles may only be connected to one another via the flexible connector loop 506, shown here as a spring. In some implementations, the two handles may be connected to one another by another attaching method.

A user may grasp the scissor assembly 500 using a palmar grasp. In some implementations, the scissor assembly 500 may be operated with a variety of grasp patterns. In some implementations, the safety scissor assembly includes a universal design for use by children, adults, and a special needs population.

In some implementations, the scissor assembly 500 is comprised of a one-piece molded plastic body, however, assembly of multiple components and use of other materials are contemplated depending on the intended use. For example, the scissor assembly 500 may include components made of rubber, thermoplastic, paper cardboard, metal foil, cloth rope wire, etc. The scissor assembly 500 may be utilized for haircutting, paper cutting, food preparation, or other applications. The size of the scissor assembly 500 may vary. In some implementations, the scissor assembly 500 may be approximately 20 cm long and 15 cm tall.

As shown in FIG. 5B, the guide post 532 and the guide slot 534 mate with each other. As a user closes the scissor assembly 500 to cut an object, the guide post 532 and the guide slot 534 guide the motion of the first handle 502 and second handle 504 as an object inserted in the mouth 524 is deflected and prevents two halves of the object from being pried apart (e.g., sheer contact is maintained).

FIG. 5C shows the scissor assembly 500 in a closed position. The guide post 532 has moved away from the limiting post in the guide slot 534, as the first handle 502 and second handle 504 approach one another and the first blade 510 and second blade 512 cross each other on a shearing plane.

Figure 6:
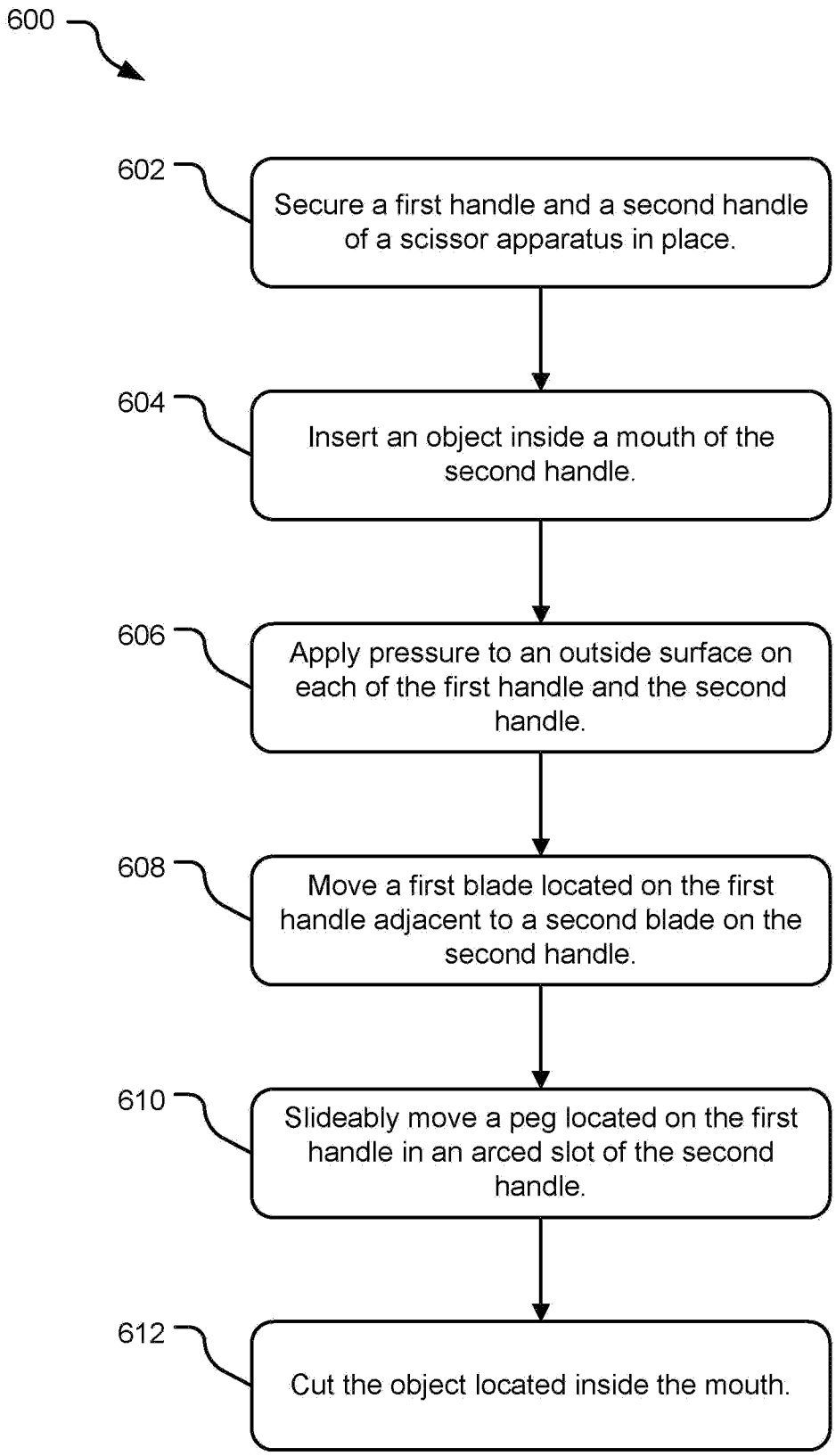
FIG. 6 is a flowchart of example operations for using an example scissor assembly.

FIG. 6 is a flowchart of example operations 600 for using an example scissor assembly. An operation 602 secures a first handle and a second handle of a scissor assembly in place. Securing the first handle and second handle may include a user positioning both handles in the user's hand, with the user's thumb on an exterior surface of one handle and the user's fingers on an exterior surface of the other handle. An operation 604 inserts an object inside a mouth of the second handle. In some implementations, there is a guard integrated on at least one of the handles. The guard allows the mouth to receive objects of predetermined size and prevents other objects of predetermined size from entering the mouth.

An operation 606 applies pressure to an outside surface on each of the first handle and the second handle of the scissor assembly in a starting position. An operation 608 moves a first blade located on the first handle adjacent to a second blade on the second handle into a cutting position. An operation 610 slidably moves a guide post or peg located on the first handle in a guide slot of the second handle. The guide slot may be an arced guide slot. In some implementations, an operation 610 moves a guide post in a guide slot, which it limited by a limiting post. The limiting post limits the distance the guide post can move in the guide slot.

In some implementations, the guide slot is an aperture or encapsulated slot with no limiting post. Thus, the guide post is limited by an edge or the surface of the guide slot.

An operation 612 cuts the object located inside the mouth. After cutting the object, the user can release pressure from the outside surface on each of the first handle and the second handle of the scissor assembly in the cutting position and return the scissor assembly to the starting position. In some implementations, the scissor assembly returns to the starting position automatically once pressure is released.

The operations making up the embodiments of the invention described herein are referred to variously as operations, steps, objects, or modules. Furthermore, it should be understood that operations may be performed in any order, adding or omitting operations as desired, unless explicitly claimed otherwise or a specific order is inherently necessitated by the claim language. For example, operations 606, 608, and 610 may occur at the same time.

The above specification, examples, and data provide a complete description of the structure and use of exemplary embodiments of the invention. Since many embodiments of the invention can be made without departing from the spirit and scope of the invention, the invention resides in the claims hereinafter appended. Furthermore, structural features of the different embodiments may be combined in yet another embodiment without departing from the recited claims.

What is claimed is:

1. A cutting apparatus, comprising:

two handles, a first handle and a second handle connecting to each other via a flexible connector loop;

a peg located on the first handle to extend through and slideably move in an arced slot of the second handle;

a mouth located in the second handle of the cutting apparatus, the mouth to receive a first object of a predetermined size;

two blades, a first blade located on a first interior surface of the first handle and a second blade located on a first interior surface of the second handle, the two blades to slide adjacent to one another to cut the first object of a predetermined size when the two handles are pushed towards each other in a starting position, wherein a cutting edge of the first blade is positioned diagonally with respect to the mouth in the second handle and the arced slot, and wherein a cutting edge of the second blade is positioned substantially perpendicular to the arced slot;

and an integrated guard located on the second handle located opposite the second blade in the mouth to prevent a second object of a predetermined size from entering the mouth, wherein the peg is located substantially above an endpoint of the first blade in the starting position, and wherein the peg and the endpoint are located substantially in the same plane.

2. The cutting apparatus of claim 1, wherein the mouth extends into the second handle adjacent to the arced slot.

3. The cutting apparatus of claim 1, further comprising a curved front on the cutting apparatus to guide feed the first object of predetermined size into the mouth.

4. The cutting apparatus of claim 1, wherein the cutting edge of the first blade is positioned diagonally with respect to the arced slot in the starting position.

5. The cutting apparatus of claim 1, wherein the mouth of the cutting apparatus is located approximately perpendicular to the arced slot.

6. The cutting apparatus of claim 1, wherein the mouth is approximately 1 cm wide.

7. The cutting apparatus of claim 1, wherein the mouth is approximately 7 cm deep.

8. The cutting apparatus of claim 1, wherein the cutting apparatus prevents contact between a user's finger and at least one of the first blade and the second blade.

* * * * *